US010843855B2

(12) United States Patent
Popp

(10) Patent No.: US 10,843,855 B2
(45) Date of Patent: Nov. 24, 2020

(54) SINGLE-PLY, NON-CORRUGATED MATERIALS SUITABLE FOR DECORATIVE WRAPPING

(71) Applicant: The Imagine Group, LLC, Shakopee, MN (US)

(72) Inventor: Mark Richard Popp, Jordan, MN (US)

(73) Assignee: The Imagine Group, LLC, Shakopee, MN (US)

( * ) Notice: Subject to any disclaimer, the term of this patent is extended or adjusted under 35 U.S.C. 154(b) by 0 days.

(21) Appl. No.: 16/459,182

(22) Filed: Jul. 1, 2019

(65) Prior Publication Data

US 2019/0375565 A1 Dec. 12, 2019

Related U.S. Application Data

(62) Division of application No. 15/386,748, filed on Dec. 21, 2016, now Pat. No. 10,336,520.

(60) Provisional application No. 62/323,521, filed on Apr. 15, 2016.

(51) Int. Cl.
*B65D 65/02* (2006.01)
*B65D 67/00* (2006.01)

(52) U.S. Cl.
CPC ..... *B65D 65/02* (2013.01); *B65D 67/00* (2013.01)

(58) Field of Classification Search
CPC ..... B65D 65/02; B65D 67/00
See application file for complete search history.

(56) References Cited

U.S. PATENT DOCUMENTS

| | | | | |
|---|---|---|---|---|
| 4,217,085 | A * | 8/1980 | Ljungberg | B26D 1/225 226/108 |
| 4,410,560 | A | 10/1983 | Kosterka | |
| 5,001,325 | A | 3/1991 | Huizinga | |
| 5,372,570 | A | 12/1994 | Schmidket et al. | |
| 5,501,912 | A * | 3/1996 | Sergenius | B21D 13/02 428/603 |
| 5,630,308 | A | 5/1997 | Guckenberger | |
| 6,050,419 | A | 4/2000 | Flanagan et al. | |
| 6,260,487 | B1 | 7/2001 | Giorgio | |
| 6,446,858 | B1 | 9/2002 | Louman | |
| 7,887,474 | B2 | 2/2011 | Pistner | |
| 7,972,257 | B2 | 7/2011 | Pistner | |
| 8,056,727 | B1 | 11/2011 | Marsh | |
| 8,668,082 | B2 | 3/2014 | Greene et al. | |
| 9,126,721 | B2 | 9/2015 | Dye et al. | |
| 2005/0069711 | A1 * | 3/2005 | Patel | B05D 7/04 428/411.1 |

(Continued)

*Primary Examiner* — Nathan L Van Sell
(74) *Attorney, Agent, or Firm* — Winthrop & Weinstine, P.A.; Alicia Griffin Mills; Nadeem W. Schwen

(57) ABSTRACT

A material for decorative wrap including a sheet of non-corrugated material having a first side, a second side, a first edge, and a second edge; a plurality of scores formed into the first side extending from the first edge to the second edge; and a plurality of scores formed into the second side extending from the first edge to the second edge. The plurality of scores formed into the first side and the plurality of scores formed into the second side may alternate such that every other score is formed into the first side and the remaining scores are formed into the second side. Each score formed into the first and second sides may extend substantially perpendicular to at least one of the first and second edges.

16 Claims, 8 Drawing Sheets

(56) References Cited

U.S. PATENT DOCUMENTS

| | | | | |
|---|---|---|---|---|
| 2006/0032928 | A1* | 2/2006 | Schaedel | B26D 5/34 235/494 |
| 2008/0216975 | A1* | 9/2008 | Farwig | B31F 1/07 162/109 |
| 2011/0073502 | A1 | 3/2011 | Greene et al. | |
| 2011/0256996 | A1* | 10/2011 | Palm | B41F 19/00 493/8 |
| 2012/0107564 | A1 | 5/2012 | Inoue et al. | |
| 2013/0008940 | A1 | 1/2013 | Schumaker et al. | |
| 2013/0095216 | A1 | 4/2013 | Pugh et al. | |
| 2013/0202853 | A1 | 8/2013 | Bergman et al. | |

* cited by examiner

SINGLE-PLY, NON-CORRUGATED MATERIALS SUITABLE FOR DECORATIVE WRAPPING

CROSS-REFERENCE TO RELATED APPLICATIONS

This application is a divisional of U.S. patent application Ser. No. 15/386,748, filed on Dec. 21, 2016, which claims priority to U.S. Provisional Patent Application No. 62/323,521, filed Apr. 15, 2016, which are hereby incorporated by reference herein in their entirety.

FIELD OF THE INVENTION

The present disclosure relates to single-ply, non-corrugated materials. Particularly, the present disclosure relates to single-ply, non-corrugated materials suitable as a decorative wrap for, for example, displaying graphics, such as around a pallet, skid, table, or other non-decorative support of products or goods, for aesthetic or advertising purposes.

BACKGROUND OF THE INVENTION

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

Conventional materials for decorative wraps for, for example, displaying graphics, such as around a pallet, skid, table, or other non-decorative support of products or goods utilize corrugated paper-based materials or corrugated plastic sheets or pads. In general, a corrugated design consists of at least two separate pieces of paper or plastic (i.e., the face sheets) that are fixedly attached to each other with fluting therebetween. The corrugation, defined by the fluting, imparts a certain level of stiffness or rigidity With regard to decorative wrapping specifically, a corrugated design often includes only a single face sheet. For example, as illustrated in FIGS. 1A and 1B, a corrugated paper-based material 100 for decorative wrapping traditionally includes a first face sheet of substantially flat paper 102 having a printable side 104 and a second face sheet of paper 106 that is fluted. The absence of a second face sheet permits the corrugated paper-based decorative wrap to be rolled for, for example, easier transportation and storage.

One known drawback of such material is that only one side, side 104, of the substantially flat face sheet is printable because the side opposite the printable side is fixedly attached to the fluted face sheet 106. Additionally, the two or more piece construction of such corrugated materials causes an increase in weight, adds bulk, and is relatively expensive to manufacture (as compared to embodiments described in the present disclosure). For example, manufacturing such a corrugated paper-based decorative wrap would traditionally include a step for printing the face sheet, a separate step for attaching the fluted face sheet, and a separate step for rolling. A relatively lower print quality, longer lead time for manufacturing, and the smaller volume that can be manufactured in a specified period of time (as compared to embodiments described in the present disclosure) are additional drawbacks of such conventional single-faced corrugated materials. Still another drawback of decorative wraps utilizing conventional corrugated materials, as shown in FIGS. 1C and 1D, is that the material does not form an aesthetically pleasing bend or fold 108 for wrapping around corners, such as the corners of a pallet, skid, table, or other non-decorative support of products or goods.

Thus, there is a need in the art for improved decorative wrapping. More particularly, there is a need for single-ply, non-corrugated materials suitable as a decorative wrap for, for example, displaying graphics, such as around a pallet, skid, table, or other non-decorative support of products or goods, for aesthetic or advertising purposes that overcomes one or more of the drawbacks of conventional decorative wraps utilizing conventional corrugated materials identified above.

BRIEF SUMMARY OF THE INVENTION

The following presents a simplified summary of one or more embodiments of the present disclosure in order to provide a basic understanding of such embodiments. This summary is not an extensive overview of all contemplated embodiments, and is intended to neither identify key or critical elements of all embodiments, nor delineate the scope of any or all embodiments.

The present disclosure, in one embodiment, relates to a material for decorative wrap. The material may include a sheet of non-corrugated material having a first side, a second side, a first edge, and a second edge; a plurality of scores formed into the first side, with each score extending for at least a portion of the distance between the first edge and the second edge; and a plurality of scores formed into the second side, with each score extending for at least a portion of the distance between the first edge and the second edge. In some embodiments, the sheet of non-corrugated material is paper-based, while in others it is a synthetic. The plurality of scores formed into the first side and the plurality of scores formed into the second side may alternate such that every other score is formed into the first side and the remaining scores are formed into the second side. At least some of the plurality of scores formed into the first and second sides may each be a continuous indentation extending from the first edge to the second edge. In other embodiments, at least some of the plurality of scores formed into the first and second sides may each be a series of discontinuous indentations, the series extending from the first edge to the second edge. Each score formed into the first and second sides may extend substantially perpendicular to at least one of the first and second edges. Although, in other embodiments, each score formed into the first and second sides may extend in a direction that is not perpendicular to the first and second edges. In some embodiments, a graphic may be formed on the first and/or second sides. In some embodiments, the sheet of non-corrugated material is single-ply. A thickness of the sheet of non-corrugated material may be between about 8 point to about 24 point. A height of the sheet of non-corrugated material measured from the first edge to the second edge may be between about 6 inches to about 16 inches. A length of the sheet of non-corrugated material measured parallel to the first or second edge may be between about 12 feet to about 100 feet. The spacing between consecutive scores of the plurality of scores formed into the first and second sides may be consistent, and in some embodiments, is 5/16 inches or greater.

The present disclosure, in another embodiment, relates to a method for manufacturing a decorative wrap. The method may include receiving a sheet of non-corrugated material having a first side, a second side, a first edge, and a second edge; forming a plurality of scores into the first side, with each score extending for at least a portion of the distance between the first edge and the second edge; and forming a plurality of scores into the second side, with each score extending for at least a portion of the distance between the first edge and the second edge. The method may also comprise printing a graphic on the first and/or second sides. In some embodiments, the steps of forming a plurality of scores into the first side, forming a plurality of scores into the second side, and printing a graphic on the first and or second sides are completed during a same set of operations performed by machine without human intervention between the operations. In a further embodiment, the method includes rolling the non-corrugated material to form a roll of the non-corrugated material.

The present disclosure, in still another embodiment, relates to another method for manufacturing a decorative wrap. The method may include receiving a sheet of non-corrugated material having a first side, a second side, a first edge, and a second edge; printing a graphic on at least one of the first or second sides; and subsequent to printing, forming a plurality of scores into at least one of the first or second sides, with each score extending for at least a portion of the distance between the first edge and the second edge. The method may also comprise printing a graphic on the other of the first or second sides. In some embodiments, the steps of printing a graphic and forming a plurality of scores into the first and/or second sides are completed during a same set of operations performed by machine without human intervention between the operations. In a further embodiment, the method includes rolling the non-corrugated material to form a roll of the non-corrugated material.

While multiple embodiments are disclosed, still other embodiments of the present disclosure will become apparent to those skilled in the art from the following detailed description, which shows and describes illustrative embodiments of the invention. As will be realized, the various embodiments of the present disclosure are capable of modifications in various obvious aspects, all without departing from the spirit and scope of the present disclosure. Accordingly, the drawings and detailed description are to be regarded as illustrative in nature and not restrictive.

BRIEF DESCRIPTION OF THE DRAWINGS

While the specification concludes with claims particularly pointing out and distinctly claiming the subject matter that is regarded as forming the various embodiments of the present disclosure, it is believed that the invention will be better understood from the following description taken in conjunction with the accompanying Figures, in which:

DETAILED DESCRIPTION

Figure 1A:
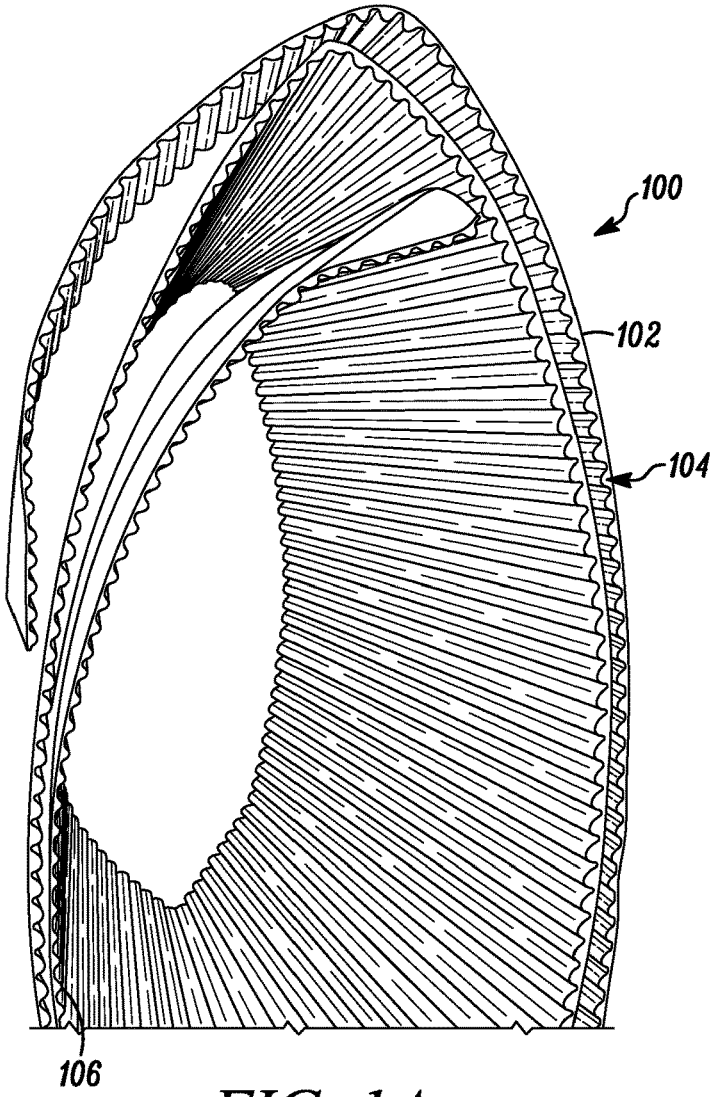
FIG. 1A is an edge view of a corrugated paper-based material used for decorative wrapping.
Figure 1B:
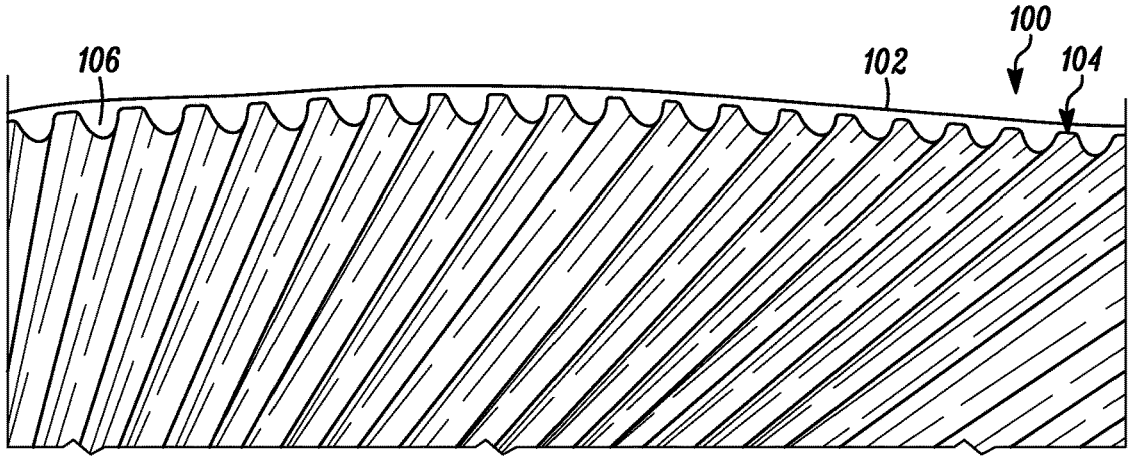
FIG. 1B is a close-up edge view of a corrugated paper-based material used for decorative wrapping.
Figure 1C:
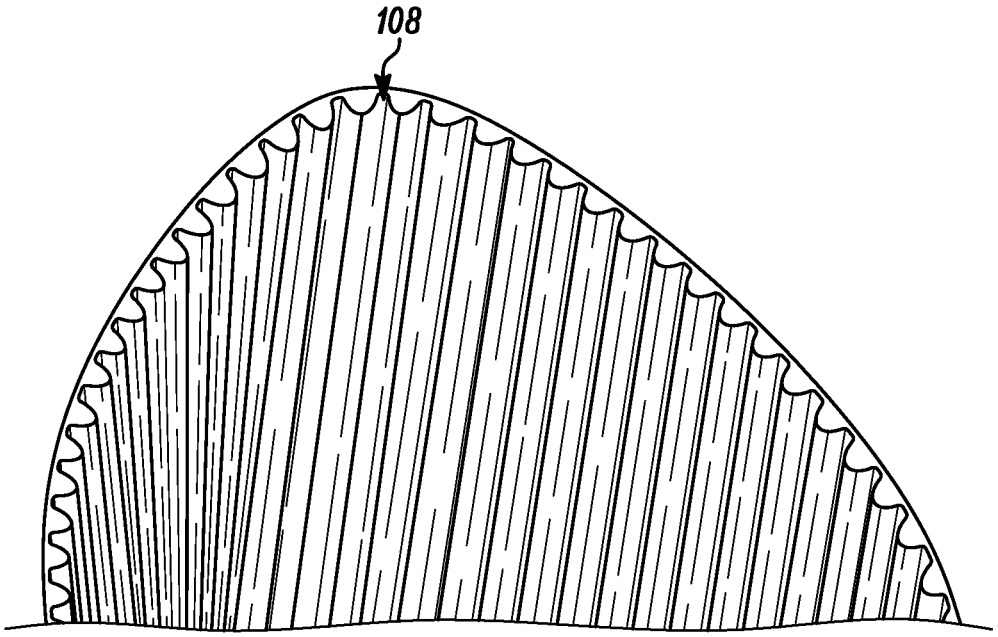
FIGS. 1C and 1D are edge views of a corrugated paper-based material used for decorative wrapping, illustrating a bend or fold of the corrugated paper-based material.
Figure 1D:
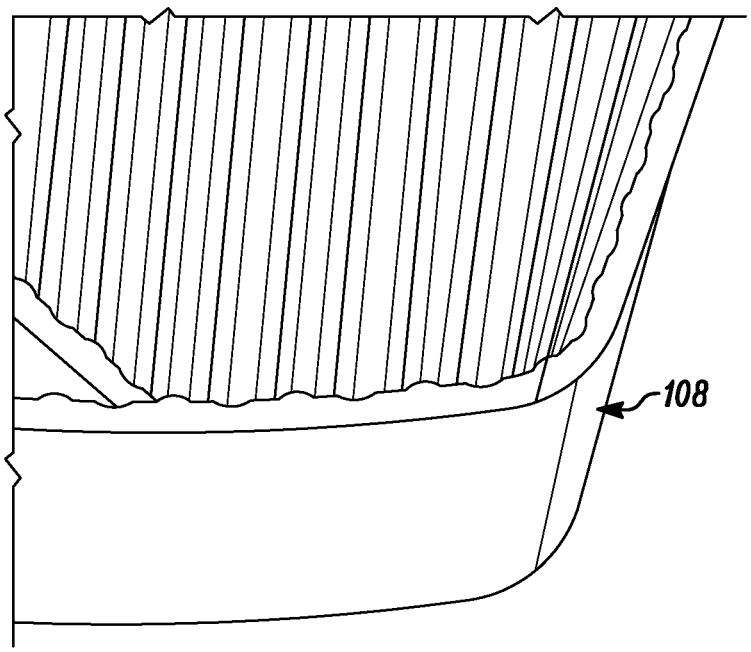
Figure 2:
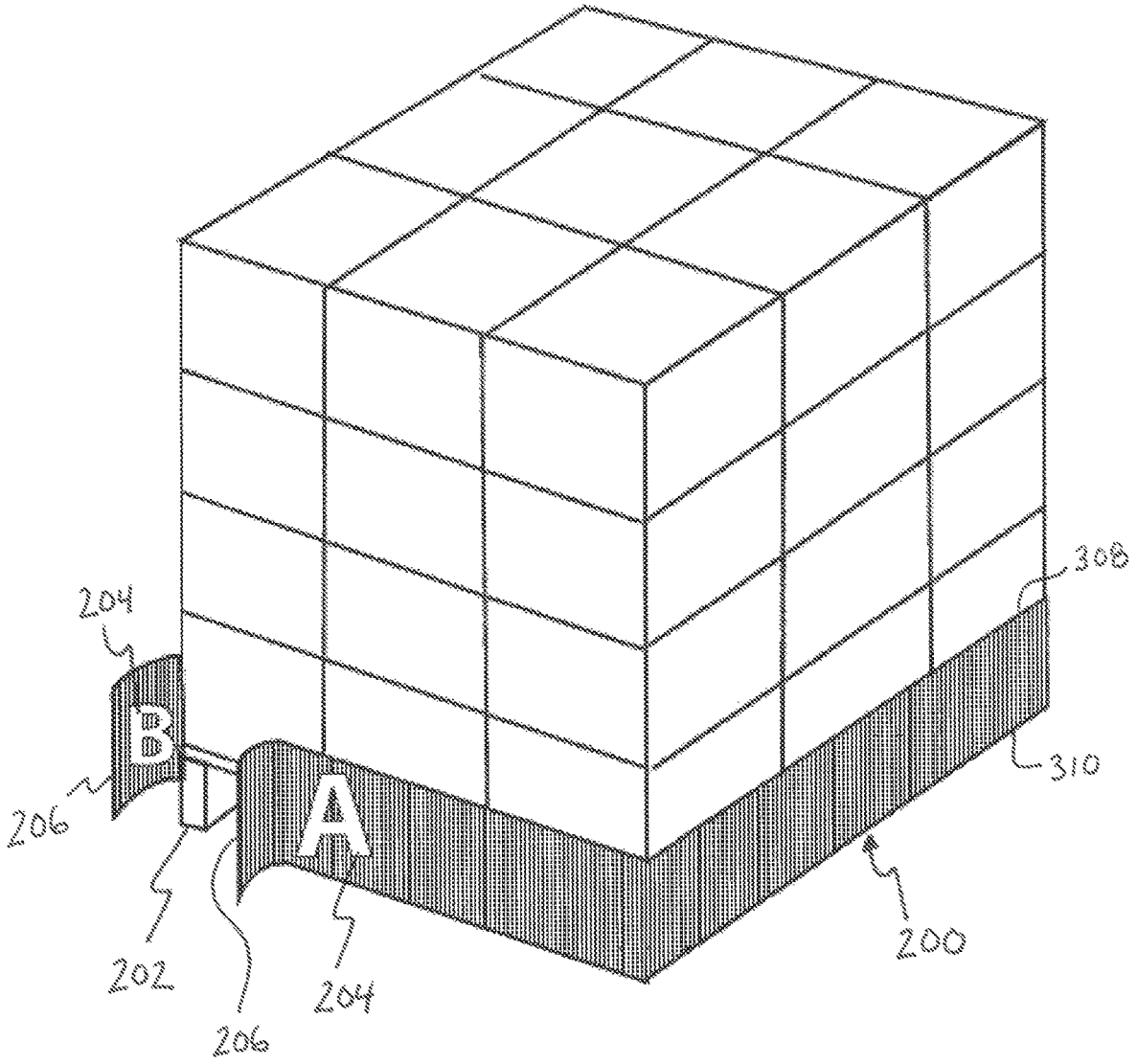
FIG. 2 is a single-ply, non-corrugated material according to one embodiment of the present disclosure shown decoratively wrapped around a skid or pallet supporting a display of products or goods thereon.

The present disclosure relates to novel and advantageous single-ply, non-corrugated materials. Particularly, the present disclosure relates to novel and advantageous single-ply, non-corrugated materials suitable as a decorative wrap for, for example, displaying graphics, such as around a pallet, skid, table, or other non-decorative support of products or goods, for aesthetic or advertising purposes. For example, as illustrated in FIG. 2, a single-ply, non-corrugated material 200 of the present disclosure may be used to wrap around, "dress up," or otherwise cover up a skid 202 or pallet supporting a display of products or goods thereon. The single-ply, non-corrugated material 200 may include a graphic 204 on one or both sides. In other embodiments, a single-ply, non-corrugated material 200 of the present disclosure may be used to wrap around or "dress up" a table, counter, or other display fixture, as well as any items stored underneath the surface of the table, counter, or other display fixture. Of course, a single-ply, non-corrugated material of the present disclosure may be used for any other suitable purpose, and its use is not limited to that of a decorative wrap. For example, other uses could include, but are not limited to: background displays, floor displays, end cap displays, wall papers, awnings, and the like.

Figure 3A:
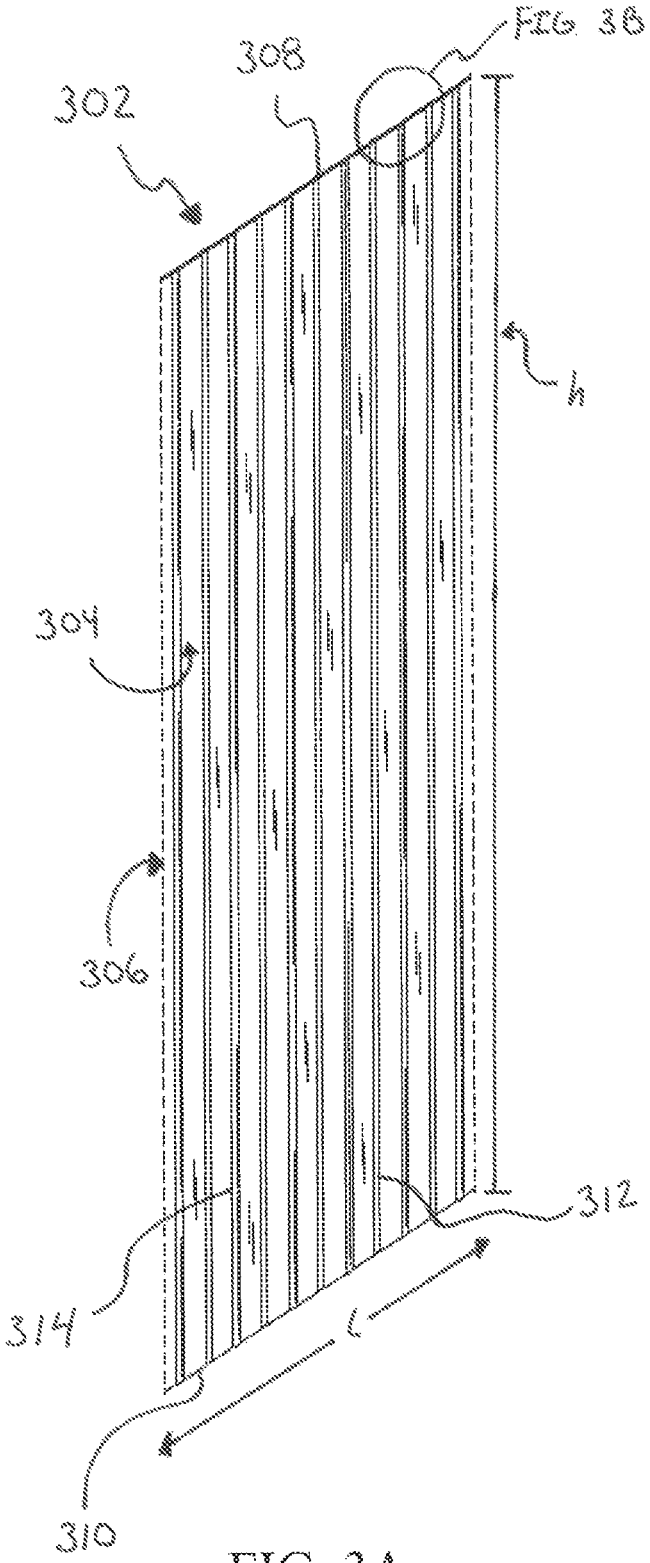
FIG. 3A is a perspective view of a section of a single-ply, non-corrugated material according to one embodiment of the present disclosure.
Figure 3B:
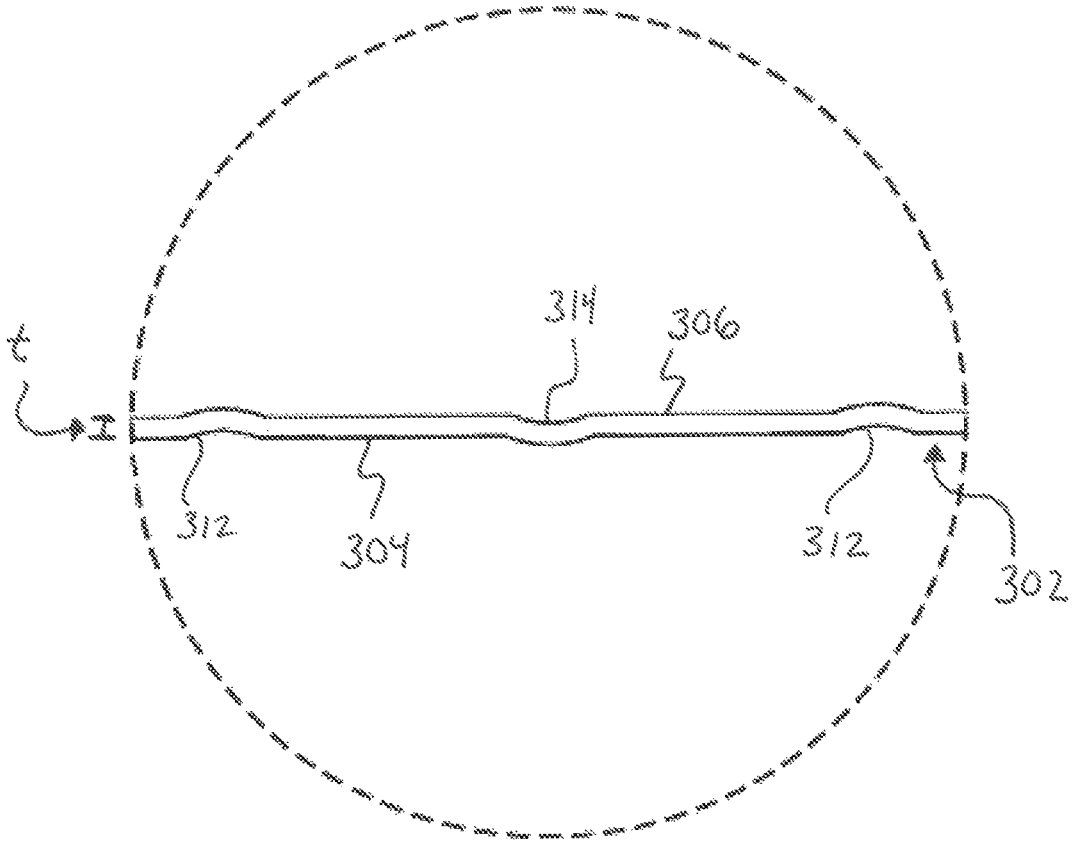
FIG. 3B is an edge view of a section of a single-ply, non-corrugated material according to one embodiment of the present disclosure.

Referring to FIGS. 3A and 3B, in one embodiment, a single-ply, non-corrugated material 300 may generally comprise a single layer or ply 302 of paper, such as paperboard or other paper-based material, or a single layer or ply of plastic or other suitable synthetic. The single layer or ply 302 may be substantially flat on both sides 304, 306, other than scoring, which will be described in further detail below. Any suitable thickness, t, of the ply 302 is contemplated. However, in many embodiments, it may be most practical for the ply 302 to have a thickness in the range of about four (4) point or mil to about forty (40) point or mil. In some embodiments, the thickness, t, of the ply 302 may be between about ten (10) point or mil to about twelve (12) point or mil. Such a thickness provides a good balance between cost and strength of the ply 302. It is noted that any numerical range described above or anywhere else herein should be interpreted to include not only the range between the explicitly recited end values, but also include all individual values and sub-ranges within the indicated range. Additionally, such an interpretation should apply regardless of the breadth of the range or the characteristics being described. While described as a single layer or ply, in some embodiments, ply 302 could be a combination or lamination of multiple plies that, in such combination, have a thickness in the ranges described above.

Any suitable height, h, of the ply 302 is also contemplated. In some embodiments, a height, h, of the ply 302 may fall in the range of about six (6) inches to about sixteen (16)

inches or more. In certain embodiments, the height, h, of the ply 302 may fall in the range of about ten (10) inches to about twelve (12) inches.

The ply 302 may be printed with text and/or graphics on one or both sides 304, 306, as shown for example in FIG. 2 (e.g., a single-ply, non-corrugated material 200 includes a graphic 204 on both sides). Printing on both sides of the ply 302 can, in some embodiments, permit multiple uses of the ply as a decorative wrap. For example, a first set of text and/or graphics may be printed on one side, while another set (or another copy of the first set) of text and/or graphics may be printed on the opposite side. During a first promotion or other event, a user may employ the ply 302 as a decorative wrap for, for example, a pallet, skid, table, or other non-decorative support with a first one of the sides 304 facing outward such that the text and/or graphics on that side are visible. During a subsequent promotion or other event, the user may again similarly employ the same ply 302 as a decorative wrap with the opposite side 306 facing outward such that the text and/or graphics on that side are now visible. Still other reasons for printing on both sides of the ply 302 exist and are contemplated by the present disclosure. In yet other embodiments, the ply 302 need not be printed at all, and may remain substantially blank.

Figure 4:
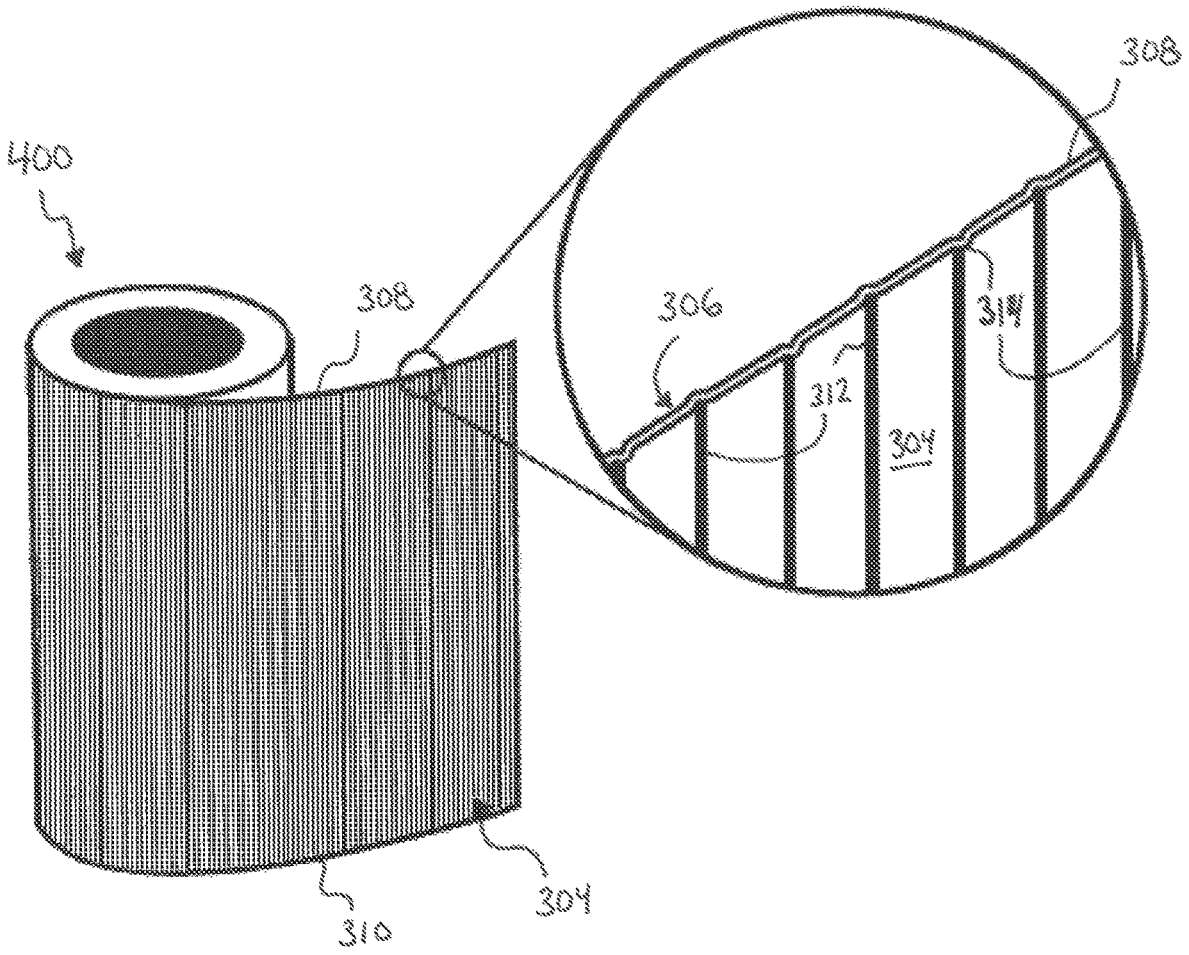
FIG. 4 includes a perspective view of a roll of a single-ply, non-corrugated material according to one embodiment of the present disclosure and an inset illustrating a close-up view of an edge of the single-ply, con-corrugated material.

The length of the ply 302 may be customizable and can be any suitable length. In embodiments of the present disclosure, the ply 302 may be formed into a roll 400, as shown in FIG. 4. The length of the ply for a roll, in many embodiments, may fall in the range of about twelve (12) feet to about one hundred (100) feet or more. A roll of above seven hundred fifty (750) feet will, in most cases, be impractical due to size and weight. However, any suitable length roll is contemplated by the present disclosure. An end user may subdivide a roll 400 into as many shorter length sections, as desired. Due to the non-corrugated nature of the ply 302, a ply of the present disclosure is rollable into relatively smaller rolls than conventional corrugated materials used as decorative wrapping of the same height and length. Likewise, a ply 302 of the present disclosure is generally lighter in weight than conventional corrugated materials used as decorative wrapping of the same height and length. Thus, in general, the various embodiments of ply 302 of the present disclosure, among other advantages, typically require less space and/or cost for transportation, handling, and storage.

As indicated above, the ply 302 may be printed with text and/or graphics on one or both sides 304, 306. In some embodiments, the text and/or graphics may be in the form of a pattern that repeats along the length of the ply 302. The pattern may be any suitable length. In one embodiment, the ply 302 may have a height, h, in the range of about ten (10) inches to about fourteen (14) inches with a repeating pattern length of about twelve (12) inches to thirty-eight (38) inches. In an even more particular embodiment, the ply 302 may have a height, h, of about twelve (12) inches with a repeating pattern length of about twenty-four (24) inches. Equipment may also be produced to create even longer pattern lengths than those explicitly described above, or long patterns may be created by stitching together or otherwise aligning, in some cases seamlessly, a combination of two or more relatively shorter patterns.

In some embodiments, one or both of the substantially flat sides 304, 306 may be coated with a laminate or may otherwise be smooth and nonabsorbent. The sides 304, 306, or more particularly, the surfaces thereof may generally be suitable or configured for providing higher quality images (or prints) relative to that attainable with conventional corrugated materials used as decorative wrapping. In some embodiments, the ply 302 may include embellishments, such as but not limited to, glitter, scratch-n-sniff characteristics, foil stamping, dull and/or glossy coatings, raised coatings, embossing and similar printing embellishments, etc., on one or both sides 304, 306. Such types of embellishments are not traditionally permitted with conventional corrugated materials used as decorative wrapping. In some embodiments, as shown in FIGS. 2-4, the ply 302 may have two straight edges 308, 310 that are generally perpendicular to the height of the ply. In other embodiments, one or both of the edges 308, 310 need not be straight or perpendicular to the height of the ply. Rather, one or both of the edges 308, 310 could be straight, but not perpendicular to the height of the ply, curved, irregular, or be patterned in any other way to achieve a desirable look. Still further, while mainly described herein with respect to a relatively long ply, the ply 302 could take on any other shape, including shapes with three (3) or more edges, or the ply 302 may be formed into any suitable three-dimensional shape or structure. Curved, irregular, or patterned edges as well as certain shapes are not traditionally practical with conventional corrugated materials used as decorative wrapping, as the flutes would likely be crushed in the process of forming such edges or shapes.

In various embodiments of the present disclosure, the ply 302 includes a plurality of scores 312, 314 formed or defined in one or both sides 304, 306 of the ply. The scores 312, 314 may impart additional stiffness or rigidity to the ply. The scores 312, 314 may generally be an indentation or deformation in the ply, often formed by use of a scoring device. In some embodiments, any given score 312, 314 may be a straight and continuous indentation or deformation beginning at one edge 308 of the ply and extending to the other edge 310 of the ply and may be substantially perpendicular to the one or both of the edges or otherwise parallel with the height, h, of the ply. In one embodiment, all scores 312, 314 are straight and continuous beginning at one edge 308 of the ply and extending to the other edge 310 of the ply and substantially perpendicular to the one or both of the edges or otherwise parallel with the height, h, of the ply. In other embodiments, any given score 312, 314 or all of the scores may be an indentation or deformation that is something other than straight. Likewise, any given score 312, 314 or all of the scores may be an indentation or deformation that is something other than continuous, sort of like a semi-perforation or quasi-perforation. In still further embodiments, any given score 312, 314 or all of the scores may be an indentation or deformation that is not perpendicular with either edge 308, 310 and/or is not parallel with the height, h, of the ply. In some embodiments, rather than being an indentation or deformation in the ply, any given score 312, 314 or all of the scores may be a series of perforations into and through the ply. Still further, any given score or set of scores 312, 314 may include or comprise of any combination of the foregoing embodiments of scores.

In some embodiments, one or more of the plurality of scores 312 may be formed or defined in a first side 304 of the ply 302 and another one or more of the plurality of scores 314 may be formed or defined in the opposite side 306 of the ply. In some embodiments, the scores alternate such that every other score 312 is formed in a first side 304 of the ply 302, and the remaining scores 314 are formed in the opposite side 306 of the ply. Any other pattern, including a random pattern, of scores where some scores are formed in one side 304 of the ply 302 while other scores are formed in the opposite side 306 may alternatively be used and is contemplated by the present disclosure.

The scores 312, 314 may be spaced apart from one another at any suitable distance. The spacing between any two consecutive scores can be substantially consistent among all scores or a subset of all the scores. However, in other embodiments, the spacing between any two consecutive scores can be different than or inconsistent with the spacing of any other two consecutive scores. In some embodiments, the spacing may be designed to space generally consistently and evenly over the length of a repeating pattern of text and/or graphics. In one embodiment, the spacing between two consecutive scores is about one quarter (¼) of an inch or more, and preferably five sixteenths (5/16) of an inch or more. Of course spacing less than five sixteenths (5/16) of an inch is possible, but issues in the manufacturing line could arise with shorter spacing between the scores.

Figure 5:
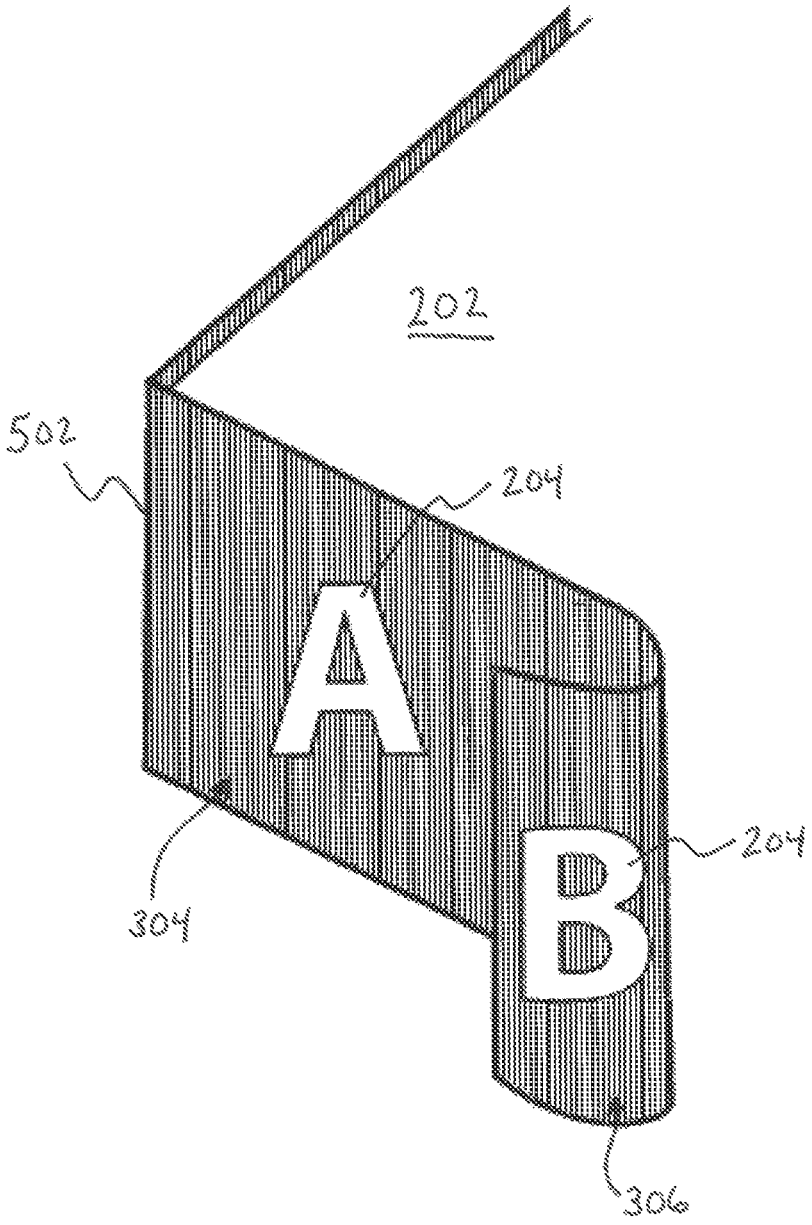
FIG. 5 is a perspective view of a single-ply, non-corrugated material according to one embodiment of the present disclosure, illustrating a bend or fold of the single-ply, con-corrugated material.
Figure 6:
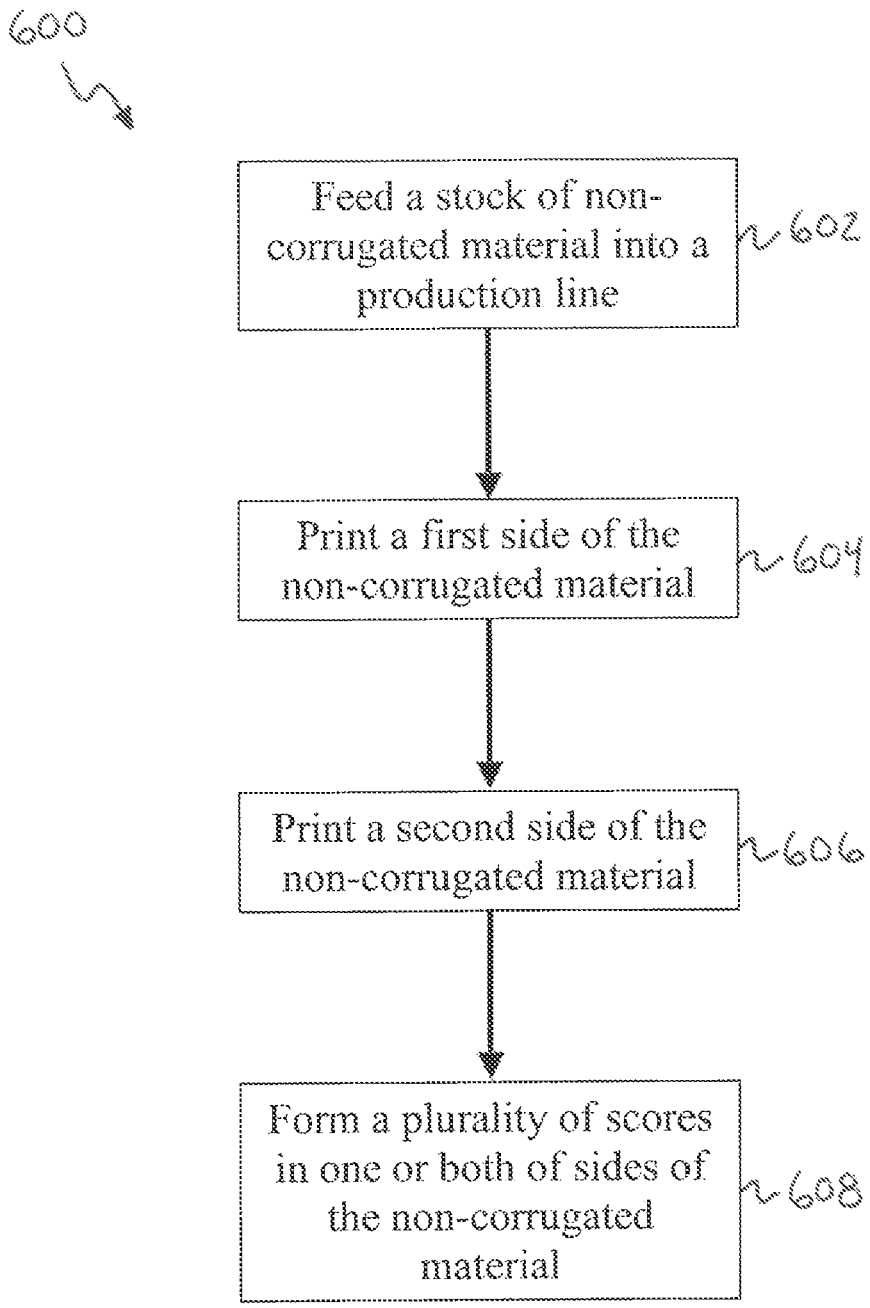
FIG. 6 is flow diagram of a method of manufacturing a single-ply, non-corrugated material according to one embodiment of the present disclosure.

In one embodiment, as shown in FIG. 5, any given score 312, 314 may provide a location along which the ply 302 may be more easily bent or folded, such as to wrap around the corner of a pallet, skid, table, or other non-decorative support. In such embodiments, long spacing between consecutive scores may be desirably avoided so that the location of a bend or fold 502 may be more precisely selected. As may be apparent, in general, the shorter the spacing between consecutive scores, the more precisely the location of a bend or fold 502 may be selected. Due to the non-corrugated nature of the ply 302 and the scores 312, 314 along which the ply can be more easily bent or folded, a bend or fold 502 in the ply looks aesthetically more pleasing than a similar bend or fold in conventional corrugated materials used as decorative wrapping A method of manufacturing a ply 302 of the present disclosure may generally include feeding a stock of non-corrugated material, such as a paper-based or paperboard material into a production line, and while the stock material is being run through the production line, optionally printing text and/or graphics on one or both sides and then forming a plurality of scores in one or both of the sides of the non-corrugated stock material. More specifically, as illustrated in FIG. 6, a method 600 of manufacturing a ply 302 of the present disclosure may begin, at step 602, with feeding a stock of non-corrugated material into a production line. The stock of non-corrugated material may be a paper-based or paperboard material or a plastic or other suitable synthetic. While passing through the production line, at step 604, a first side 304 of the non-corrugated material may be printed with text and/or graphics. In some embodiments, at step 606, a second side 306 of the non-corrugated material may also be printed with text and/or graphics while passing through the production line. Printing of both sides 304, 306 could occur substantially simultaneously or could occur sequentially. For example, in the same production line process or otherwise during the same pass or trip through the production line, a first side 304 of the non-corrugated material may be printed with text and/or graphics, the non-corrugated material may be flipped over in-process, if desired, and then a second side 306 of the non-corrugated material may be printed with text and/or graphics. In either a subsequent production line process or during the same production line process, at step 608, a plurality of scores 312, 314 may be formed in one or both of the sides 304, 306 of the non-corrugated stock material. In one embodiment, the production line may include a roll scorer through which the non-corrugated material is passed to form scores 312 on a first side 304. The production line may also include a second roll scorer through which the non-corrugated material is passed to form scores 314 on the opposite side 306. However, in another embodiment, the production line may include set of roll scorers that operate in combination, somewhat like two gears, in order to form scores 312, 314 in both sides 304, 306 of the non-corrugated material substantially simultaneously. The roll scorers may be configured to form scores in the non-corrugated material that alternate such that every other score 312 is formed in a first side 304 of the non-corrugated material 302, and the remaining scores 314 are formed in the opposite side 306 of the non-corrugated material. The roll scorers may alternatively be configured to form any other pattern, including a random pattern, of scores in the non-corrugated material such that some scores are formed in one side 304 of the non-corrugated material 302 while other scores are formed in the opposite side 306. Still other methods of forming scores in the non-corrugated material are available and contemplated by the present disclosure. The non-corrugated material could be further subjected to any additional processing, including but not limited to, lamination, trimming, or rolling, such as for easier handling, transportation, and storage.

Although the flowchart of FIG. 6 illustrates a method as comprising sequential steps or a process as having a particular order of operations, many of the steps or operations in the flowchart illustrated herein can be performed in parallel or concurrently, and the flowchart should be read in the context of the various embodiments of the present disclosure. In addition, the order of the method steps or process operations illustrated in the flowchart may be rearranged for some embodiments. Similarly, a method or process illustrated in the flow chart could have additional steps or operations not included therein or fewer steps or operations than those shown.

Although not required in all embodiments, as indicated above, the printing and scoring of the non-corrugated material may be performed in the same production line process or otherwise during the same pass or trip through the production line. As used herein, reference to the same production line process is intended to refer to, among any standard or industry specific definitions, a set of simultaneous and/or sequential operations performed or completed by machine without human intervention. As such, in one embodiment, the printing and scoring of the non-corrugated material may be performed during the same set of simultaneous and/or sequential operations performed or completed by machine without human intervention. In further embodiments, the printing, scoring, and additional processing, such as but not limited to lamination, trimming, or rolling of the non-corrugated material, may be performed during the same set of simultaneous and/or sequential operations performed or completed by machine without human intervention. Using a process as described above to make a resulting ply 302 as described above makes it practical to produce as little as a single roll of the ply cost-effectively. It is generally not practical or cost-effective to produce only a single roll of conventional corrugated materials used as decorative wrapping.

As described above, the resulting ply 302 may be used as a decorative wrap for, for example, displaying graphics, such as around a pallet, skid, table, or other non-decorative support of products or goods, for aesthetic or advertising purposes. The ply 302, when wrapped around such a pallet, skid, table, or other non-decorative support, may be connected at two ends (such as ends 206 in FIG. 2) using any suitable attachment mechanism or means, including but not limited to tape, staple(s), adhesive(s), interlocking joint(s), hook-and-loop fastener(s), etc. In some embodiments, the ply 302 may pre-incorporate one or more of such attachment means, such as tape, an adhesive, an interlocking joint, and/or a hook-and-loop fastener, for ease of application by an end user of the ply as a decorative wrap. Attachment mechanisms or means tend to work better to hold the ends (such as ends 206 in FIG. 2) of the ply 302 together as compared to the ends of conventional corrugated materials used as decorative wrapping because the fluting of such corrugated materials tends to reduce the performance of the attachment mechanisms.

As used herein, the terms "substantially" or "generally" refer to the complete or nearly complete extent or degree of an action, characteristic, property, state, structure, item, or result. For example, an object that is "substantially" or "generally" enclosed would mean that the object is either completely enclosed or nearly completely enclosed. The exact allowable degree of deviation from absolute completeness may in some cases depend on the specific context. However, generally speaking, the nearness of completion will be so as to have generally the same overall result as if absolute and total completion were obtained. The use of "substantially" or "generally" is equally applicable when used in a negative connotation to refer to the complete or near complete lack of an action, characteristic, property, state, structure, item, or result. For example, an element, combination, embodiment, or composition that is "substantially free of" or "generally free of" an element may still actually contain such element as long as there is generally no significant effect thereof.

In the foregoing description various embodiments of the present disclosure have been presented for the purpose of illustration and description. They are not intended to be exhaustive or to limit the invention to the precise form disclosed. Obvious modifications or variations are possible in light of the above teachings. The various embodiments were chosen and described to provide the best illustration of the principals of the disclosure and their practical application, and to enable one of ordinary skill in the art to utilize the various embodiments with various modifications as are suited to the particular use contemplated. All such modifications and variations are within the scope of the present disclosure as determined by the appended claims when interpreted in accordance with the breadth they are fairly, legally, and equitably entitled.

The invention claimed is:

1. A method for manufacturing a decorative wrap, the method comprising:

receiving a sheet of single-ply non-corrugated material having a first side, a second side, a first edge, and a second edge;

forming a plurality of scores into the first side, each score extending for at least a portion of the distance between the first edge and the second edge; and forming a plurality of scores into the second side, each score extending for at least a portion of the distance between the first edge and the second edge;

wherein the steps of forming the plurality of scores into the first side and forming the plurality of scores into the second side are performed by deforming the single-ply non-corrugated material to impart stiffness to the non-corrugated material.

2. The method of claim 1, further comprising printing a graphic or text on the first side.

3. The method of claim 2, further comprising printing a graphic or text on the second side.

4. The method of claim 2, wherein the steps of forming a plurality of scores into the first side, forming a plurality of scores into the second side, and printing a graphic or text on the first side are completed during a same set of operations performed by machine without human intervention between the operations.

5. The method of claim 4, further comprising rolling the single-ply non-corrugated material to form a roll of the non-corrugated material.

6. The method of claim 2, wherein printing the graphic or text is done before forming a plurality of scores into the first side.

7. The method of claim 1, wherein the sheet of single-ply non-corrugated material is paper-based.

8. The method of claim 1, further comprising spacing the plurality of scores on the first and second sides to provide a plurality of scored locations at which the sheet of single-ply non-corrugated material can be selectively folded to form a corner in the single-ply non-corrugated material.

9. The method of claim 1, wherein the sheet of single-ply non-corrugated material has a third edge and a fourth edge opposite one another and perpendicular to the first edge and the second edge, and wherein forming a plurality of scores into the first side and forming a plurality of scores into the second side is alternated over a distance between the third edge and the fourth edge to form every other score into the first side and the remaining scores into the second side.

10. The method of claim 1, wherein forming a plurality of scores into the first side or forming a plurality of scores into the second side includes forming a subset of the plurality of scores as a continuous indentation extending from the first edge to the second edge.

11. The method of claim 1, further comprising adding an embellishment to the first side, wherein adding the embellishment to the first side is done before forming a plurality of scores into the first side.

12. The method of claim 1, further comprising coating at least one of the first side and the second side with a laminate.

13. The method of claim 1, wherein forming a plurality of scores into the first side comprises forming a plurality of scores into the first side in a direction substantially perpendicular to at least one of the first and second edges, and forming a plurality of scores into the second side comprises forming a plurality of scores into the second side in a direction substantially perpendicular to at least one of the first and second edges.

14. The method of claim 1, wherein forming a plurality of scores into the first side comprises forming a plurality of scores into the first side in a direction that is not perpendicular to at least one of the first and second edges, and forming a plurality of scores into the second side comprises forming a plurality of scores into the second side in a direction that is not perpendicular to at least one of the first and second edges.

15. A method for manufacturing a decorative wrap, the method comprising:

receiving a sheet of single-ply non-corrugated material having a first side, a second side, a first edge, and a second edge;

forming a plurality of scores into the first side, each score extending for at least a portion of the distance between the first edge and the second edge; and forming a plurality of scores into the second side, each score extending for at least a portion of the distance between the first edge and the second edge;

wherein the plurality of scores in the first side alternate with the plurality of scores in the second side; and wherein the steps of forming the plurality of scores into the first side is performed by deforming the single-ply non-corrugated material to impart stiffness to the single-ply non-corrugated material.

16. The method of claim 15, further comprising rolling the sheet of single-ply non-corrugated material to form a roll of the non-corrugated material.

* * * * *